US010302288B2

(12) United States Patent
Bader et al.

(10) Patent No.: US 10,302,288 B2
(45) Date of Patent: May 28, 2019

(54) DEVICE CARRIER FOR A STRIP-LIGHTING LUMINAIRE

(71) Applicant: ZUMTOBEL LIGHTING GMBH, Dornbirn (AT)

(72) Inventors: Martin Bader, Dornbirn (AT); Wolfgang Bechter, Hittisau (AT); Wolfgang Gadner, Horbranz (AT); Gerald Ladstatter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 53 days.

(21) Appl. No.: 15/524,009

(22) PCT Filed: Dec. 14, 2015

(86) PCT No.: PCT/EP2015/079571
§ 371 (c)(1),
(2) Date: May 3, 2017

(87) PCT Pub. No.: WO2016/096708
PCT Pub. Date: Jun. 23, 2016

(65) Prior Publication Data

US 2018/0073711 A1 Mar. 15, 2018

(30) Foreign Application Priority Data

Dec. 17, 2014 (DE) ..... 20 2014 106 111 U

(51) Int. Cl.
*F21V 23/00* (2015.01)
*F21V 23/06* (2006.01)
(Continued)

(52) U.S. Cl.
CPC ..... *F21V 23/002* (2013.01); *F21S 4/28* (2016.01); *F21V 21/005* (2013.01);
(Continued)

(58) Field of Classification Search
CPC ..... F21V 23/002; F21V 23/06; F21V 23/026; F21S 4/28
(Continued)

(56) References Cited

U.S. PATENT DOCUMENTS

2006/0044841 A1 3/2006 Harwood
2013/0279180 A1 10/2013 Pearson et al.
(Continued)

FOREIGN PATENT DOCUMENTS

DE 3102189 9/1982
DE 4416110 11/1995
(Continued)

OTHER PUBLICATIONS

German Search Report dated Jul. 17, 2015 in pending priority German Application 20 2014 106 111.8.
(Continued)

*Primary Examiner* — Karabi Guharay
(74) *Attorney, Agent, or Firm* — Andrus Intellectual Property Law

(57) ABSTRACT

The present invention relates to a device carrier (10) for a strip-lighting luminaire, comprising: first lines (14) for forming a first power supply circuit; second lines (14) for forming a second power supply circuit; and at least one converter unit (12) for electrically coupling the first to the second power supply circuit, said converter unit being mounted on the device carrier (10). The first lines (14) are arranged on a rear face of the device carrier (10) so that the first lines (14) are concealed by the device carrier (10) in the mounted state of the strip-lighting luminaire. The invention further relates to a strip-lighting luminaire comprising at least one device carrier (10) according to the invention.

10 Claims, 4 Drawing Sheets

(51) Int. Cl.

| | |
|---|---|
| ***F21V 23/02*** | (2006.01) |
| ***F21S 4/28*** | (2016.01) |
| ***F21V 21/005*** | (2006.01) |
| *F21S 2/00* | (2016.01) |
| *F21Y 115/10* | (2016.01) |
| *F21Y 103/10* | (2016.01) |

(52) U.S. Cl.
CPC ..... *F21V 23/023* (2013.01); *F21V 23/026* (2013.01); *F21V 23/06* (2013.01); *F21S 2/00* (2013.01); *F21Y 2103/10* (2016.08); *F21Y 2115/10* (2016.08)

(58) Field of Classification Search
USPC ..... 362/219
See application file for complete search history.

(56) References Cited

U.S. PATENT DOCUMENTS

| | | | | |
|---|---|---|---|---|
| 2014/0049954 | A1 | 2/2014 | Ladstaetter | |
| 2014/0225132 | A1* | 8/2014 | Livesay | H01L 33/641 257/88 |
| 2015/0109772 | A1 | 4/2015 | Ladstaetter | |
| 2016/0138769 | A1 | 5/2016 | Hehle | |
| 2016/0195250 | A1* | 7/2016 | Park | F21S 8/038 362/219 |

FOREIGN PATENT DOCUMENTS

| | | |
|---|---|---|
| DE | 20 2006 005920 | 6/2006 |
| DE | 10 2008 051 481 | 5/2009 |
| DE | 10 2010 17702 | 10/2012 |
| DE | 20 2012 101 765 | 10/2013 |
| DE | 20 2013 102 670 | 10/2014 |
| EP | 1045201 | 10/2000 |
| EP | 2650607 | 10/2013 |

OTHER PUBLICATIONS

International Search Report dated Feb. 8, 2016 in parent PCT Patent Application PCT/EP2015/079571.
Austria Search Report dated Oct. 27, 2016 in co-pending Austria Application GM 170/2015.

* cited by examiner

DEVICE CARRIER FOR A STRIP-LIGHTING LUMINAIRE

CROSS REFERENCE TO RELATED APPLICATION

The present application is the U.S. national stage application of International Application PCT/EP2015/079571, filed Dec. 14, 2015, which international application was published on Jun. 23, 2016 as International Publication WO 2016/096708 A1. The International Application claims priority to German Patent Application 20 2014 106 111.8, filed Dec. 17, 2014.

FIELD OF THE INVENTION

The present invention relates to a device mount for a strip-lighting lamp assembly, and a strip-lighting lamp assembly having such a device mount.

BACKGROUND

Numerous different strip-lighting lamp assemblies are known from the prior art. Large spaces (e.g. super markets, factories, office spaces, etc.) can be equipped using strip-lighting lamp assemblies, or strip-lighting systems, with long light lines adapted to these spaces. Normally, these strip-lighting lamp assemblies have u-shaped strip-lighting tracks, in which the wiring, the (control) electronics and the lighting means are disposed.

To simplify the installation, it is furthermore known to construct the strip-lighting lamp assemblies with modular units, as much as possible. By way of example, DE 20 2012 101 765 U1 discloses a first module in the form of a device mount, and a second module in the form of a lighting means mount, disposed in a u-shaped strip-lighting track. The device mount has a converter unit disposed thereon, specifically for the electrical coupling of the lighting means to the external power supply conducted to the strip-lighting lamp assembly. The lighting means mount on the other hand comprises the actual lighting means, e.g. LEDs or fluorescent tubes.

It has, however, been shown that in practice, that the provision of the wiring for the individual modules, or the strip-lighting lamp assemblies connecting one another, necessary for operating the strip-lighting lamp assemblies, or the strip-lighting system, is comparably time consuming, and is furthermore prone to error. Typically, when installing a strip-lighting system normally comprising numerous (individual) strip-lighting lamp assemblies, at least one contact to an external power supply, an electrical contact for the individual strip-lighting lamp assemblies among themselves, and an electrical contact for the respective lighting means mount to the device mount, or the device mounts, must be established. Furthermore, with known strip-lighting lamp assemblies there is the disadvantage that the wiring for an installed strip-lighting lamp assembly may be exposed, which could disrupt the lighting impression of the strip-lighting lamp assembly, or the strip-lighting system, respectively.

Based on this prior art, the present invention addresses the objective of creating a device mount with which an installation of a strip-lighting lamp assembly is substantially simplified, with which the error rate of the wiring is reduced, and with which the wiring is not visible on the installed strip-lighting lamp assemblies, which could disrupt the lighting impression of the strip-lighting lamp assemblies.

This and other objectives, which shall be specified below, or may be obvious to a person skilled in the art are achieved by the invention.

SUMMARY OF THE INVENTION

A device mount according to the invention for a strip-lighting lamp assembly comprises at least:

- first lines for forming a first power supply circuit (with the external power supply);
- second lines for forming a second power supply circuit (for power supply of the individual light modules of the strip-lighting lamp assemblies);
- at least one converter unit disposed on the device mount for the electrical coupling of the first and second power supply circuits;
- wherein the first lines are disposed on a back surface of the device mount, such that the first lines are covered by the device mount when the strip-lighting lamp assemblies are installed.

In other words, the present invention proposes that the first lines that are to be disposed on the device mount are disposed thereon such that the lines are always covered by the device mount in the installed state, such that no visible lines are able to disrupt the light impression of the strip-lighting lamp assemblies. With the device mount according to the invention, there is also the possibility to pre-install substantially all of the wiring for the electrical and electronic components in the factory, such that a technician does not have to install any wiring during the installation of a strip-lighting lamp assembly according to the invention, and furthermore no longer has to install any wiring for the device mount prone to error, but rather, simply has to attach the device mount to the strip-lighting track, and subsequently electrically and mechanically connect the lighting means mount by means of the first and second plug-in connector assembly.

Preferably, the second lines are likewise disposed on the back surface of the device mount, such that the second lines are also covered by the device mount when the strip-lighting lamp assembly is installed. This also comprises a design in which at least a portion of the second lines are disposed on the back surface of the device mount, or the second lines are partially disposed on the back surface of the device mount, such that at least this portion of the second lines is covered by the device mount when the strip-lighting lamp assembly is in the installed state. The portion of the second lines which is then not disposed on the back surface of the device mount, comprises the smallest possible section of the second lines; in particular the shortest possible connection between the back surface to a connection region on the converter unit, preferably provided on the front surface thereof. It is particularly preferred thereby that the first and second lines are already pre-installed in the factory, and securely attached to the device mount, such that no more individual wiring has to be carried out during the installation of a strip-lighting lamp assembly. Advantageously, plug-in connector assemblies (which likewise can already be provided with the wiring in the factory) need only be connected to corresponding plug-in connector assemblies in order to be able to provide a complete wiring of the strip-lighting lamp assembly. Additionally or alternatively, the second lines can be at least partially disposed on the front surface of the device mount.

The device mount is preferably made substantially from sheet metal. The device mount is particularly preferably designed thereby as an integral stamped/folded part.

The device mount advantageously has a substantially u-shaped cross section, wherein the first and/or the second lines (thus at least the portion of the second lines located on the back surface of the device mount) are preferably disposed inside the u-shaped cross section (i.e. in the region formed by the two legs of the u-shaped cross section). As a result, there is the possibility of disposing the lines in a region protected by the u-shaped device mount, such that do not become unintentionally displaced during transport or installation.

The converter unit is advantageously disposed on a front surface of the device mount. The front surface of the device mount is understood to be the region of the device mount lying opposite the lighting means mount in the installed state. The first power supply circuit is connected thereby to the external power supply (in particular a typical 230V power supply) for the strip-lighting lamp assembly, wherein the converter unit provides a usable current/voltage ratio for the lamp modules (in particular LED lamp modules).

Advantageously, the second power supply circuit comprises at least one first plug-in connector assembly disposed on the front surface of the device mount, which is configured to engage with a second plug-in connector assembly disposed on a lighting means mount, in order to connect the at least one lighting means mount to the second power supply circuit.

Preferably only one converter unit is provided on the device mount, with which the lighting means mount(s) are connected in series, i.e. starting from the converter unit, an electrical connection to the first plug-in connector assembly is established, which can be engaged with a first lighting means mount, wherein the electrical connection then either leads back to the converter unit, or to another first plug-in connector assembly, on which a second lighting means mount can be disposed. In this case, an electrical connection from the second first plug-in connector assembly back to the converter unit is established. If another first plug-in connector assembly is provided on the device mount, a connection back to the converter unit from the last first plug-in connector assembly connected in series is provided, in order to again close the power supply circuit.

Advantageously, the first plug-in connector assembly is electrically connected to the second lines on the back surface of the device mount. It is furthermore preferred that the converter unit is likewise electrically connected to the first and second lines on the back surface of the device mount. As a result, there is the possibility of disposing the lines for the first plug-in connector assembly from the converter unit, or the electrical lines to the first plug-in connector assembly, or to the first plug-in connector assembly, respectively, such that these are not visible when the strip-lighting track is in the installed state, and thus cannot disrupt the lighting impression of the strip-lighting lamp assembly.

Advantageously, the device mount comprises at least one splitter plug-in connector assembly, having first connecting means for connecting the first and second lines. A splitter plug-in connector assembly of this type can be created, for example, from plastic housings, which form an appropriate receiving strip (e.g. a clamping strip), in which the first and second lines can be received and clamped in place.

It is furthermore advantageous when the splitter plug-in connector assembly comprises second connection means, which can engage with a supply plug-in connector in order to connect the first lines to an external power supply. By way of example, the second connection means can be configured as socket elements, in which the plug elements of the supply plug-in connector assembly can be inserted.

Lastly, it is advantageous when the splitter plug-in connector assembly comprises third connection means, which can engage with a bridge plug-in connector assembly of another device mount, in order to connect the first and/or second lines of the device mount to the first and/or second lines of the other device mount. Here as well, the third connection means can be created by appropriate socket elements, in which plug elements of the bridge plug-in connector assembly of the other device mount can be received.

As a result, it is preferred that the splitter plug-in connector assembly comprises three connection means, specifically for receiving the first and second lines, for connecting to the supply plug-in connector assembly and for connecting to a bridge plug-in connector assembly of another device mount.

Advantageously, the first and/or second lines of the device mount are connected to at least one bridge plug-in connector assembly, which is designed to engage with a third connection means of a splitter plug-in connector assembly of another device mount, in order to connect the first and/or second lines of the device mount to first and/or second lines of the other device mount. In this preferred embodiment, the technician must only connect the supply plug-in connector assembly to the second connection means of the splitter plug-in connector assembly, and if there are other device mounts in the strip-lighting system, the bridge plug-in connector assembly to the third connection means of another device mount, in order to be able to obtain a complete wiring of numerous device mounts.

The present invention also relates to a strip-lighting lamp assembly, which comprises at least one device mount as described above.

BRIEF DESCRIPTION OF THE DRAWINGS

A description of the figures shall be provided below.

DETAILED DESCRIPTION

Figure 1:
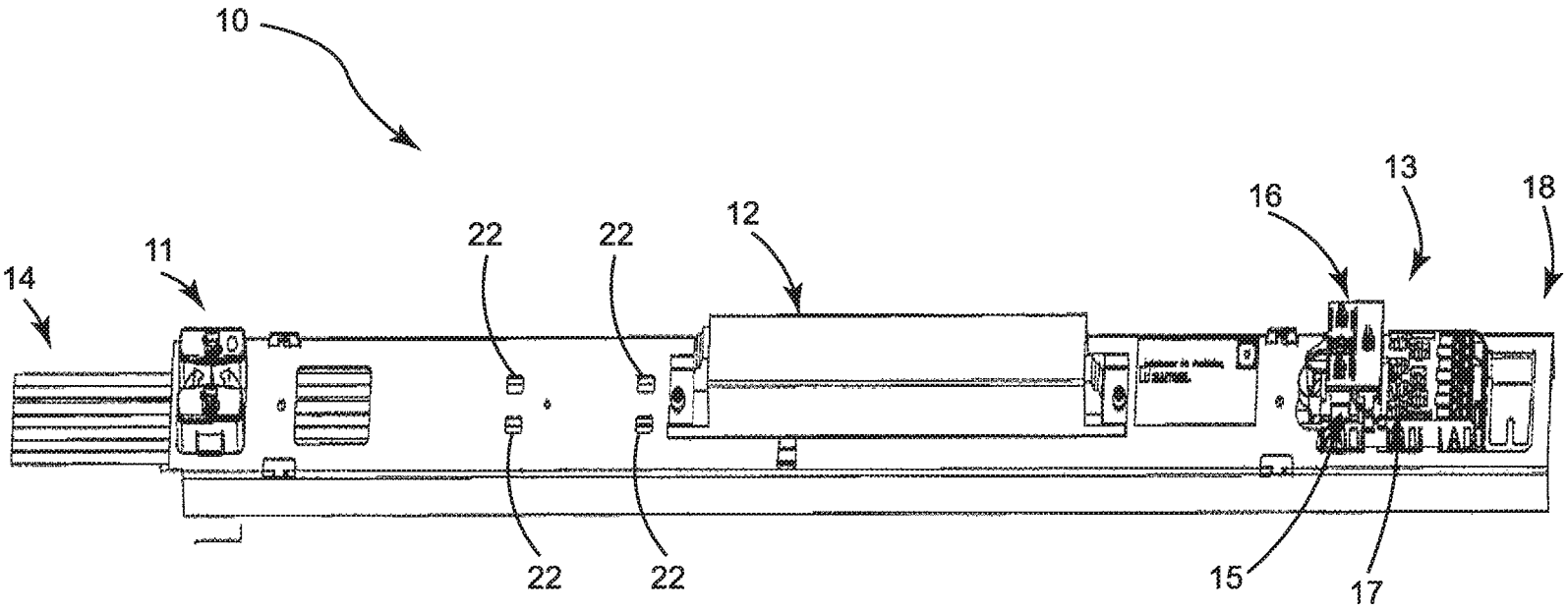
FIG. 1 shows a schematic front view of a first embodiment of a device mount according to the invention.

FIG. 1 shows a schematic view of a first embodiment of a device mount 10 according to the invention, wherein the front surface of the device mount 10 is shown in FIG. 1.

The device mount 10 has a substantially u-shaped cross section, and is made of sheet metal in a substantially integral form. The device 10 is preferably designed thereby as a stamped/folded part.

A first plug-in connector assembly 11 is disposed on the front surface (or the upper surface) of the device mount, which is designed to engage with a second plug-in connector assembly disposed on lighting means mount (not shown), in order to connect the lighting means mount to the power supply circuit. Furthermore, a converter unit 12 and a splitter plug-in connector assembly 13 are disposed on the front surface of the device mount 10.

Figure 2:
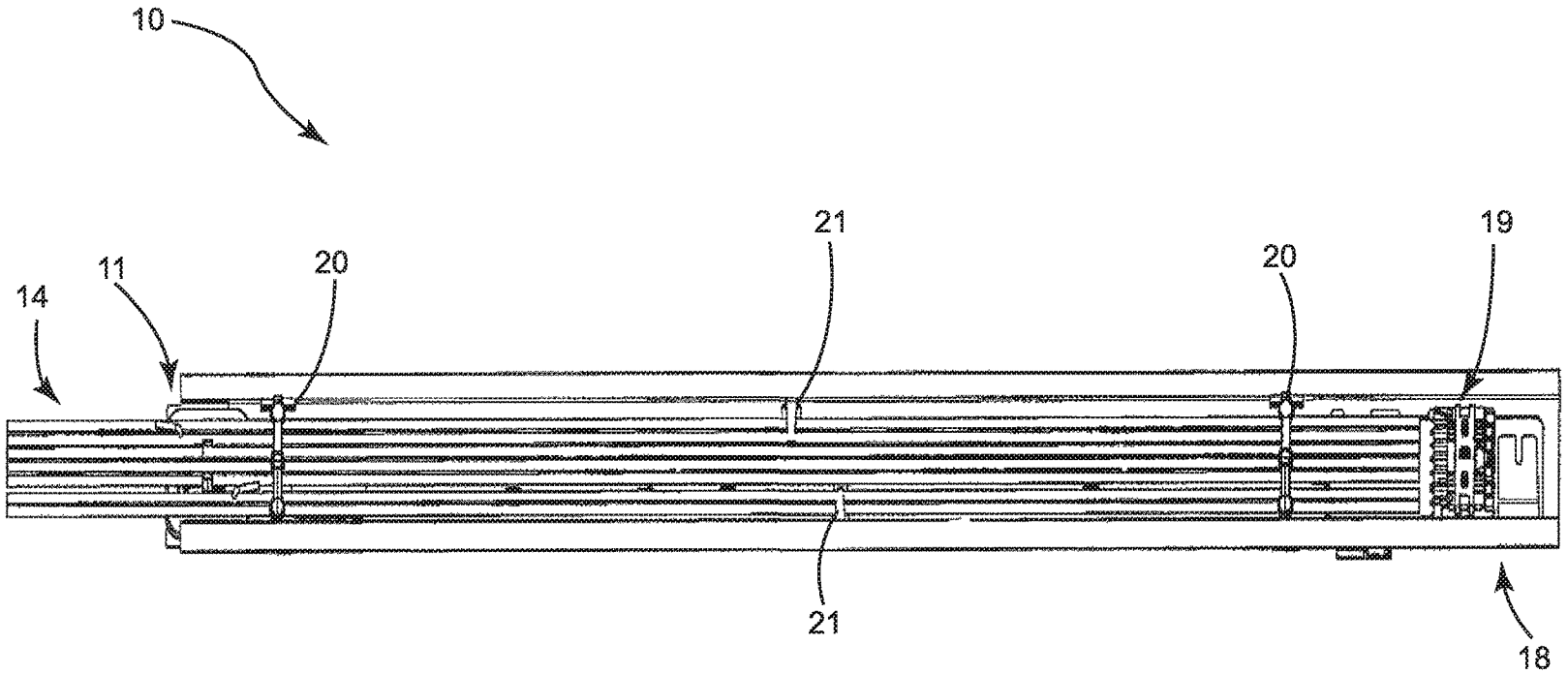
FIG. 2 shows a schematic back view of the device mount from FIG. 1.

As can be seen in FIG. 1, lines 14 are guided laterally in the u-shaped device mount 10 (specifically, in the region formed by the legs of the u-shaped device mount 10), and extend at the back to the splitter plug-in connector assembly 13 (cf. FIG. 2). The lines 14 comprise a first line for forming a first power supply circuit, which can be connected to an external power supply source, and preferably a second line for forming a second power supply circuit, with which the lighting means of a lighting means mount (not shown) can be operated. The lighting means mount is electrically connected thereby to the second lines by means of the first plug-in connector assembly 11.

The splitter plug-in connector assembly 13 comprises first connection means (cf. FIG. 2) in which the lines 14 can be clamped, and second connection means 15 into which a supply plug-in connector assembly 16 can be inserted in order to connect the first lines of the lines 14 disposed in the splitter plug-in connector assembly 13 to an external power supply. Lastly, the splitter plug-in connector assembly 13 comprises third connection means 17 in which a bridge plug-in connector assembly (not shown) of another device mount can be received, in order to connect the lines 14 (first and second lines) to a splitter plug-in connector assembly of another device mount.

The first lines of the lines 14, which are connected to an external power supply via the supply plug-in connector assembly 16, are guided along the back surface of the device mount 10 into the converter unit 12. The converter unit 12 provides a current/voltage ratio that can be used by the lighting means, which is conducted to the first plug-in connector assembly 11 via the second lines of the lines 14. Furthermore, numerous holes 22 are provided in the device mount 10 (in particular in the region in front of and behind the converter unit 12), through which the first lines can also be guided along the front surface to the converter unit 12, or second lines can be guided away from the converter unit 12.

Lastly, the device mount 10 comprises an attachment means 18, at least at an edge region, preferably in the form of a bent part (which is advantageously formed as an integral part of the device mount 10), on which the device mount 10 can be attached to a lighting track (not shown).

FIG. 2 shows a schematic view of the device mount 10 from FIG. 1, wherein the back surface of the device mount 10 is depicted in FIG. 2.

As can be seen in FIG. 2, the lines 14 are guided laterally on the back surface of the device mount, and extend to the splitter plug-in connector assembly 13, and are received therein in the first connection means 19 (preferably by means of appropriate clamping or screw connections). The lines 14 (i.e. the first and second lines) are secured thereby in the region formed by the legs of the u-shaped device mount 10 by means of numerous securing rails 20.

As can likewise be readily seen in FIG. 2, the lines 14 are connected to the converter unit 12 by means of clamps 21 (specifically, the converter unit 12 is functionally disposed between the first and second lines).

Furthermore, a bridge plug-in connector assembly (not shown) is provided in the region extending beyond the device mount 10, in order to engage the lines 14 with a third connection means of a splitter plug-in connector assembly of another device mount, in order to be able to connect the lines 14 to another device mount. As a result, there is the possibility of connecting numerous device mounts 10 to one another, e.g. in order to use the shown converter unit 12 for operating numerous lighting means mounts, or to use the external power supply provided at one device mount 10 for numerous device mounts.

Figure 3:
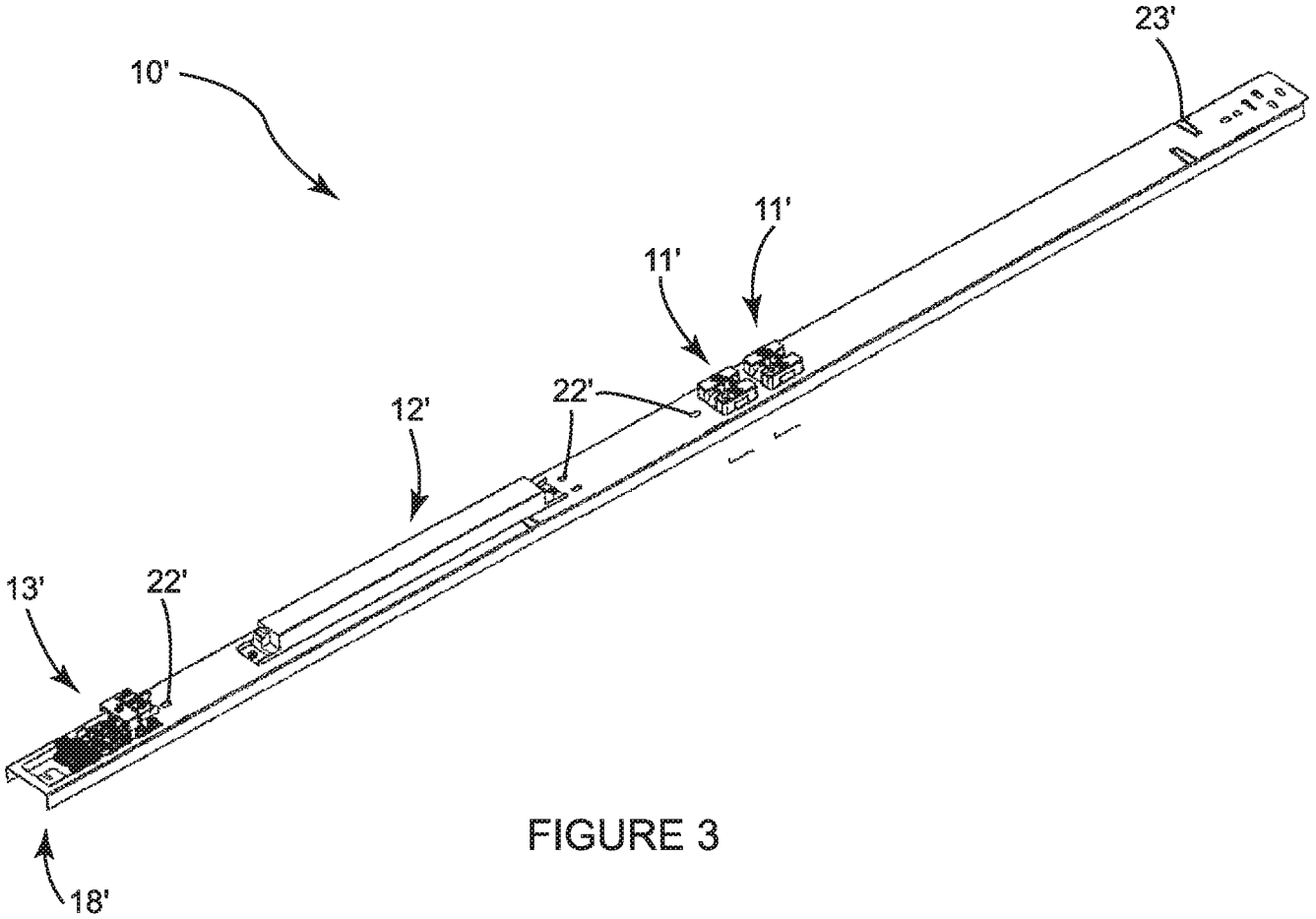
FIG. 3 shows a second preferred embodiment of a device mount according to the invention.

FIG. 3 shows a schematic view of a second embodiment of a device mount 10'. In differing from the device mount 10, the device mount 10' comprises two first plug-in connector assemblies 11', on which a lighting means mount (not shown) can be disposed in each case.

As can be readily seen in FIG. 3, the device mount 10' is longer than the device mount 10 shown in FIGS. 1 and 2, such that further attachment means 23' (here in the form of screw lugs) are provided on the side of the device mount 10' lying opposite the splitter plug-in connector assembly 13'. Identical features are provided with identical reference symbols, wherein the features of the second exemplary embodiment are marked with an apostrophe.

Figure 4:
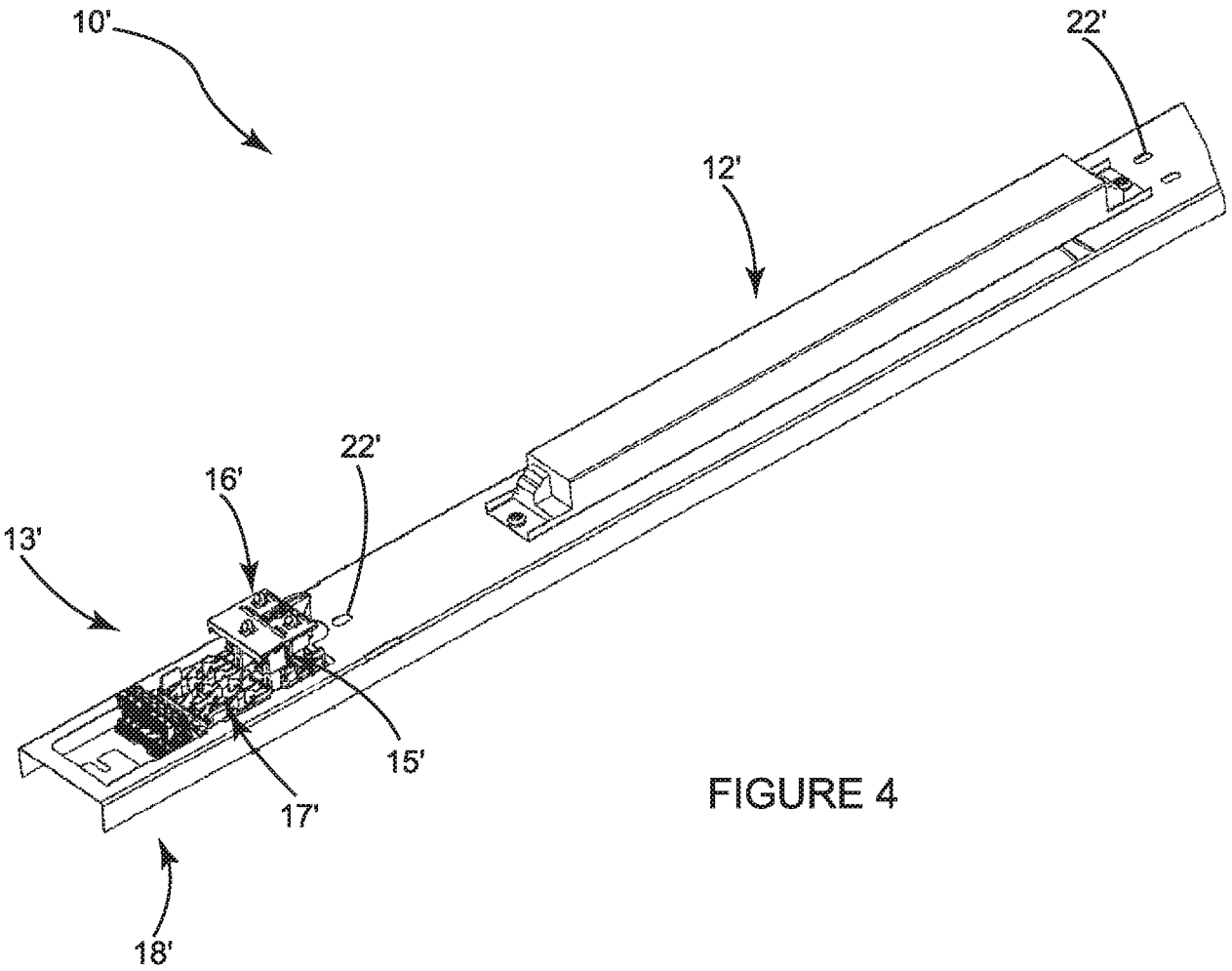
FIG. 4 shows a schematic view of the device mount shown in FIG. 3.

FIG. 4 shows a detailed view of the device mount 10'. As can be readily seen in FIG. 4, the splitter plug-in connector assembly 13' is disposed such that it is spaced apart from the edge of the device mount 10', such that the attachment means 18' (formed here by an L-shaped angle part having screw lugs) can be provided in the immediate edge region.

This arrangement of the attachment means 18' and the splitter plug-in connector assembly 13' is particularly preferred, because this results in the attachment means 18' being substantially accessible, i.e. none of the lines, nor the splitter plug-in connector assembly 13' need to be removed for the installation, in order to be able to attach the device mount 10' in a strip-lighting track, or to a part of a building.

With the device mounts 10, 10' described above, there is the possibility of pre-installing substantially the entire wiring (in particular the duct wiring, the wiring of the converter unit and the wiring of the first plug-in connector assembly or assemblies) at the factory. Accordingly, the wiring is covered when the device mount 10, 10' is installed, such that negative influence on the lighting impression is avoided.

Furthermore, by pre-installing the wiring at the factory it is possible to prevent defective wiring from occurring during installation in the field. Moreover, with the device mounts 10, 10' described above, there is the possibility of operating the lighting means with only one converter unit, or only enough converter units need to be provided as are necessary for operating the strip-lighting system. In other words, there is the possibility of optimizing the workload of the respective converter units, and to thus reduce the number of converter units in the strip-lighting system.

Lastly, through the modular construction of a strip-lighting lamp assembly with the device mounts 10, 10' described above, the respective modules can be produced from a comparatively more economical material (preferably as sheet metal), while in contrast, the outer lamp housing that can be seen in the installed state can be made of a qualitative high-grade material having a more appealing appearance (e.g. cast aluminum). On the whole, a strip-lighting lamp assembly having a device mount 10, 10' can thus be produced more economically. Furthermore, the device mounts 10, 10' described above can be used with numerous different strip-lighting lamp assemblies, such that a cost advantage can be realized through the use of interchangeable parts in this regard.

The present invention is not limited to the preferred exemplary embodiment described above, as long as it is comprised of the subject matter of the following Claims. In particular, the present invention is not limited to the use of device mounts having just one plug-in connector assembly. On the contrary, depending on the application, numerous lighting means mounts can be disposed on a device mount that comprises a corresponding number of first plug-in connectors.

What is claimed is:

1. A strip-lighting assembly comprising:

an elongated lighting track having a substantially u-shaped channel and mounted such that legs of the channel extend toward a space that is intended to be illuminated;

an elongated device mount (10; 10') attached to the lighting track and residing within the channel of the elongated lighting track, the device mount having:

a substantially u-shaped cross section with a front face facing the space that is intended to be illuminated and legs that extend away from the space that is intended to be illuminated; first lines (14) for forming a first power supply circuit connected to an external power supply, said first lines (14) being disposed inside the u-shaped cross section of the device mount and disposed on a back surface of the device mount (10; 10') such that the first lines (14) are covered by the device mount (10; 10') when the elongated device mount has been installed in the elongated lighting track;

second lines (14) for forming a second power supply circuit to supply power to LED light modules, wherein the second power supply circuit has a first plug-in connector assembly (11; 11') disposed on the front surface of the device mount (10; 10');

at least one converter unit (12; 12') disposed on the front face of the device mount (10; 10') for electrically coupling the first and second power supply circuits;

a lighting means mount including an LED light module and a second plug-in connector which is configured to engage with the first plug-in connector assembly disposed on a lighting means mount in order to electrically connect the LED light module on the one lighting means mount to the second power supply circuit.

2. The device mount (10; 10') according to claim 1, wherein the second lines (14) are disposed at least in part on the back surface of the device mount (10; 10'), such that at least this portion of the second lines (14) are covered by the device mount (10; 10') when the strip-lighting lamp assembly has been installed.

3. The device mount (10; 10') according to claim 1, wherein the device mount (10; 10') is substantially made of a sheet metal.

4. The device mount (10; 10') according to claim 1, wherein the second lines (14) are disposed entirely inside the u-shaped cross section of the device mount.

5. The device mount (10; 10') according to claim 1, wherein the first plug-in connector assembly (11; 11') is electrically connected to the second lines (14) on the back surface of the device mount (10; 10').

6. The device mount (10; 10') according to claim 1, wherein the converter unit (12; 12') is electrically connected to the first and second lines (14) on the back surface of the device mount (10; 10').

7. The device mount (10; 10') according to claim 1, wherein the device mount (10; 10') comprises at least one splitter plug-in connector assembly (13; 13'), having first connection means (19) for connecting the first and second lines (14) on the back face of the device mount.

8. The device mount (10; 10') according to claim 7, wherein the splitter plug-in connector assembly (13; 13') comprises second connection means (15) that can engage with a supply plug-in connection means (16), in order to connect the first lines (14) to an external power supply.

9. The device mount (10; 10') according to claim 7, wherein the splitter plug-in connector assembly (13; 13') comprises third connection means, which can engage with a bridge plug-in connector assembly of another device mount, which is connected to the first and/or second lines of the other device mount, in order to connect the first and/or second lines (14) of the device mount (10; 10') to the first and/or second lines of the other device mount.

10. The device mount (10; 10') according to claim 1, wherein the first and/or second lines (14) of the device mount (10; 10') are connect to at least one bridge plug-in connector assembly, which is configured to engage with a third connection means of a splitter plug-in connector assembly of another device mount, in order to connect the first and/or second lines (14) of the device mount (10; 10') to first and/or second lines of the other device mount.

* * * * *